United States Patent [19]

Dunn, Jr.

[11] Patent Number: 4,847,994

[45] Date of Patent: Jul. 18, 1989

[54] REMOTELY ACTUATED TOE NAIL CLIPPER

[76] Inventor: Sam Dunn, Jr., 1132-5th St., Clute, Tex. 77531

[21] Appl. No.: 178,426

[22] Filed: Apr. 6, 1988

[51] Int. Cl.[4] ..... A45D 29/00

[52] U.S. Cl. ..... 30/28; 30/123; 350/244; 132/73

[58] Field of Search ..... 30/26, 27, 28, 29, 123; 132/73.5, 75.4, 75.5, 76.2, 73, 73.6, 75.8; 350/243, 244

[56] References Cited

U.S. PATENT DOCUMENTS

| | | | |
|---|---|---|---|
| D. 156,233 | 11/1949 | Henkel . | |
| D. 192,590 | 4/1962 | Leopoldi . | |
| D. 195,614 | 7/1963 | Sacko . | |
| D. 209,942 | 1/1968 | Berry . | |
| D. 242,959 | 1/1977 | Saito . | |
| D. 286,091 | 10/1986 | Hill . | |
| 857,790 | 6/1907 | Carroll | 30/29 |
| 1,449,165 | 3/1923 | Cameron | 30/123 |
| 3,499,698 | 3/1970 | Malys | 350/243 X |
| 3,504,716 | 4/1970 | Bush et al. | 30/123 |
| 3,680,210 | 8/1972 | Steinman | 350/244 X |
| 4,341,015 | 7/1982 | Young | 30/28 |

FOREIGN PATENT DOCUMENTS

| | | | |
|---|---|---|---|
| 959853 | 2/1957 | Fed. Rep. of Germany | 30/28 |

*Primary Examiner*—Frank T. Yost
*Assistant Examiner*—Michael D. Folkerts
*Attorney, Agent, or Firm*—Jerry T. Kearns

[57] ABSTRACT

A remotely actuated toe nail clipper includes a cylindrical tubular housing which encloses an axially reciprocating plunger rod. A leaf spring type toe nail clipper extends through a slot in a bottom portion of the housing. An actuating lever of the toe nail clipper is in engagement with the plunger rod. A scissor mechanism extends transversely through a slot in an upper portion of the housing for actuating the plunger rod. The device is particularly designed for use by individuals who have difficulty reaching their toe nails with conventional forms of nail clippers. In a second embodiment, the axially movable plunger rod is electrically actuated by a solenoid mechanism. An adjustable telescope is mounted in parallel relation to the cylindrical housing and provides an individual with a clear view of the toe nail clipper.

6 Claims, 5 Drawing Sheets

REMOTELY ACTUATED TOE NAIL CLIPPER

BACKGROUND OF THE INVENTION

1. Field of the Invention

The present invention relates to toe nail clippers, and more particularly pertains to a new and improved remotely actuated toe nail clipper particularly adapted for use by individuals who have difficulty reaching their toe nails with conventional forms of toe nail clippers. Many older individuals, overweight individuals and physically disabled individuals have extreme difficulty in trimming their toe nails with conventinal forms of toe nail clippers. In fact, many individuals find it entirely impossible to trim their toe nails with these conventional devices and are forced to seek assistance in trimming their toe nails. In order to overcome this problem, the present invention provides a toe nail clipper with a mechanism for enabling remote actuation, thus allowing individuals to trim their toe nails without extreme bending or stooping. In a second embodiment of the present invention, a telescope enables individuals with poor eyesight to have a clear view of their toe nails during a trimming operation.

2. Description of the Prior Art

Various types of toe nail clippers are known in the prior art. A typical example of such a toe nail clipper is to be found in U.S. Design Pat No. 156,233, which issued to A. Henkel on Nov. 29, 1949. This patent discloses a conventional form of leaf spring type toe nail clipper. U.S. Design Pat. No. 192,590, which issued to N. Leopoldi on Apr. 10, 1962, discloses a leaf spring type nail clipper which has a generally circular configuration. U.S. Design Pat. No. 195,614, which issued to J. Sacko on July 2, 1963, discloses a conventional leaf spring type nail clipper having a generally oval built-up finger gripping surface. U.S. Design Pat. No. 209,942, which issued to W. Berry on Jan. 16, 1968, disclosed a nail clipper which has plier type handles which are actuated by an elongated attached lever. U.S. design Pat. No. 242,959, which issued to T. Saito on Jan. 4, 1977, discloses a leaf spring type nail clipper in an elongated generally cylindrical housing. U.S. Design Pat. No. 286,091, which issued to L. Hill on Oct. 7, 1986, discloses a leaf spring type nail clipper with elongated, generally transversely extending handles.

While the above mentioned devices are suited for their intended usage, none of these devices provide a remotely actuated toe nail clipper adapted for use by individuals who cannot bend or stoop over. Additionally, none of these prior art nail clippers provide a remotely actuated toe nail clipper which utilizes a scissor mechanism to reciprocate an axially movable plunger to actuate a leaf spring type toe nail clipper. Additional features of the present invention, not contemplated by the aforesaid prior art devices, includes the provision of a telescope in conjunction with a solenoid remote actuated toe nail clipper to enable individuals who cannot bend or stoop over to conveniently trim their toe nails without assistance. Inasmuch as the art is relatively crowded with respect to these various types of toe nail clippers, it can be appreciated that there is a continuing need for and interest in improvements to such toe nail clippers, and in this respect, the present invention addresses this need and interest.

SUMMARY OF THE INVENTION

In view of the foregoing disadvantages inherent in the known types of toe nail clippers now present in the prior art, the present invention provides an improved remotely actuated toe nail clipper. As such, the general purpose of the present invention, which will be described subsequently in greater detail, is to provide a new and improved remotely actuated toe nail clipper which has all the advantages of the prior art toe nail clippers and none of the disadvantages.

To attain this, representative embodiments of the concepts of the present invention are illustrated in the drawings and make use of a cylindrical tubular housing which encloses an axially reciprocating plunger rod. A leaf spring type toe nail clipper extends through a slot in a bottom portion of the housing. An actuating lever of the toe nail clippers is in engagement with the plunger rod. A scissor mechanism extends transversely through a slot in an upper portion of the housing for actuating the plunger rod. The device is particularly designed for use by individuals who have difficulty reaching their toe nails with conventional forms of nail clippers. In a second embodiment, the axially movable plunger rod may be electrically actuated by a solenoid mechanism. An adjustable telescope is mounted in parallel relation to the cylindrical housing and provides an individual with a clear view of the toe nail trimming operation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved remotely actuated toe nail clipper which has all the advantages of the prior art toe nail clippers and none of the disadvantages.

It is another object of the present invention to provide a new and improved remotely actuated toe nail clipper which may be easily and efficiently manufactured and marketed.

It is a further object of the present invention to provide a new and improved remotely actuated toe nail clipper which is of a durable and reliable construction.

An even further object of the present invention is to provide a new and improved remotely actuated toe nail clipper which is susceptible of a low cost of manufacture with regard to both materials and labor, and which accordingly is then susceptible of low prices of sale to the consuming public, thereby making such toe nail clippers economically available to the buying public.

Still yet another object of the present invention is to provide a new and improved remotely actuated toe nail clipper which provides in the apparatuses and methods of the prior art some of the advantages thereof, while simultaneously overcoming some of the disadvantages normally associated therewith.

Still another object of the present invention is to provide a new and improved remotely actuated toe nail clipper to enable individuals who cannot bend over or stoop, to trim their toe nails without assistance.

Yet another object of the present invention is to provide a new and improved remotely actuated toe nail clipper which utilizes a tubular housing enclosing an axially reciprocal plunger which is actuated by a scissor mechanism to operate a leaf spring type toe nail clipper.

Even still another object of the present invention is to provide a new and improved remotely actuated toe nail clipper which utilizes an electric solenoid actuated axial plunger to operate a leaf spring type toe nail clipper and is provided with a telescope to enable individuals with poor eyesight, who cannot bend or stoop, to conveniently trim their toe nails.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
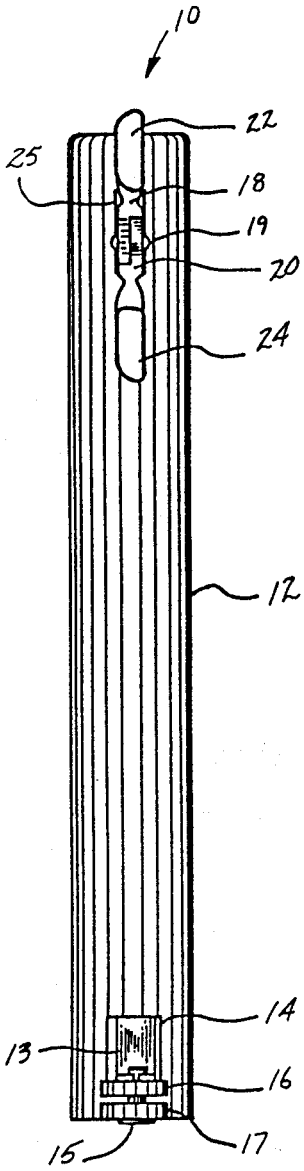
FIG. 1 is a front view of the remotely actuated toe nail clipper according to the first embodiment of the present invention.

With reference now to the drawings, and in particular to FIG. 1 thereof, a new and improved remotely actuated toe nail clipper embodying the principles and concepts of the present invention and generally designated by the reference numeral 10 will be described.

More specifically, it will be noted that the first embodiment 10 of the invention includes an elongated hollow cylindrical tubular housing 12 having a generally rectangular notch 14 adjacent a bottom portion thereof. A leaf spring type toe nail clipper has a pair of generally parallel spaced spring steel cutting portions 16 and 17 which are loosely connected by a pin 15 which allows the cutting portions 16 and 17 to be moved together and apart. An actuating lever 14 is connected in conventional fashion to the pin 15 for purposes of forcing the cutting portions 16 and 17 together for trimming a toe nail. The leaf spring type toe nail clipper is of a conventional form and need not be further described herein. A scissor actuating mechanism mounted adjacent a top portion of the housing 12, includes a first lever portion 18 and a second lever portion 20 which are pivotally connected by means of a rivet 19. Loop handle grips 22 and 24 are provided respectively on end portions of the first lever 18 and the second lever 20. The first and second scissor levers 18 and 20 are mounted through a generally rectangular slot 25 and extend transversely into the interior of the housing 12.

Figure 2:
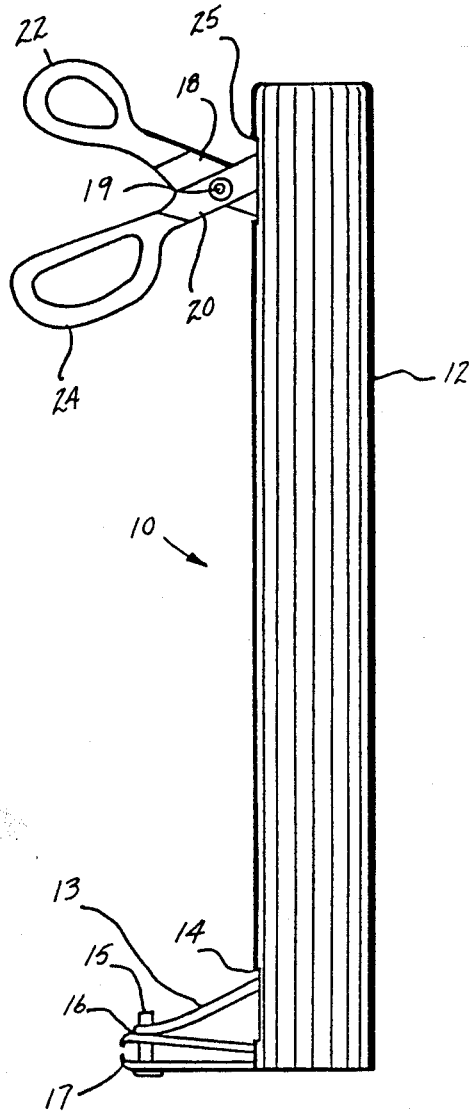
FIG. 2 is a side view of the remotely actuated toe nail clipper according to the first embodiment of the present invention.

In FIG. 2, a side view of the nail clipper 10 of the first embodiment of the present invention is depicted. The housing 12 has a length from eighteen to twenty four inches so that an individual may place their toe nails in position between the cutting elements 16 and 17 of the leaf spring type toe nail clipper and actuate the lever 13 by squeezing the handles 22 and 24 of the scissor mechanism together, without excessive bending or stooping. The nail clipper 10 may be easily utilized by an individual seated in a chair.

Figure 3:
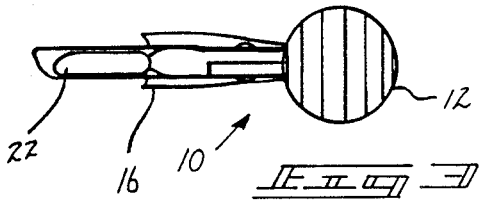
FIG. 3 is a top view of the remotely actuated toe nail clipper according to the first embodiment of the present invention.

FIG. 3 provides a top plan view of the toe nail clipper 10 of the first embodiment of the present invention.

Figure 4:
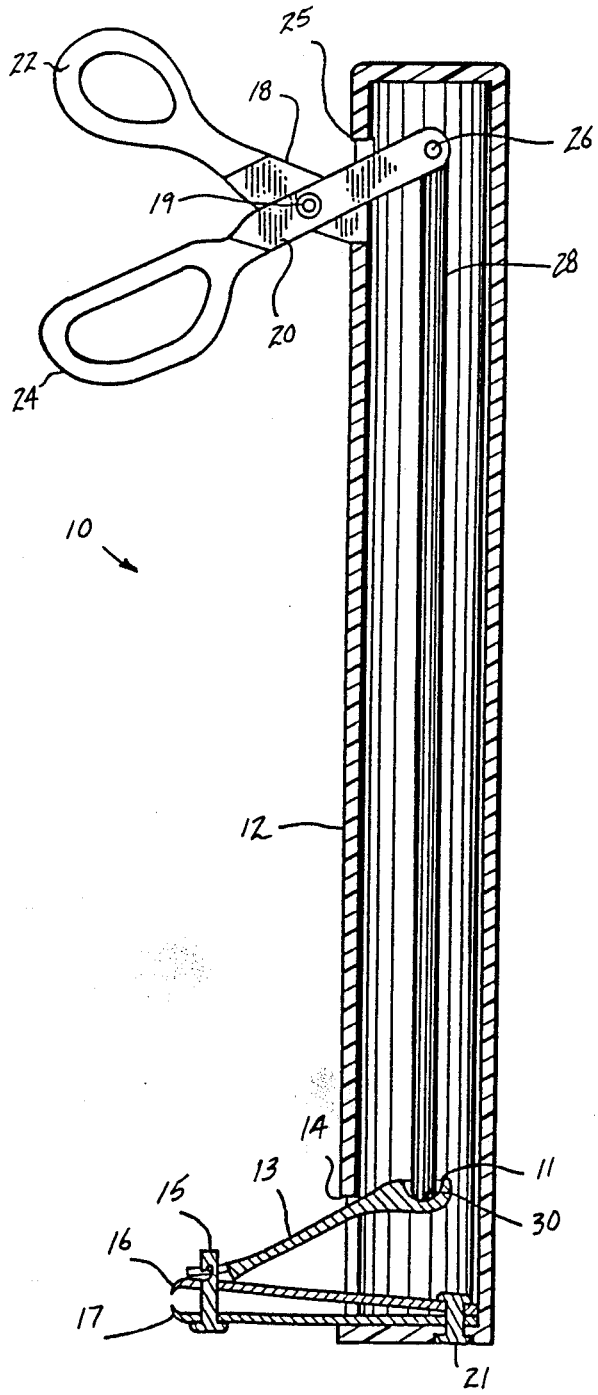
FIG. 4 is a longitudinal cross sectional view of the toe nail clipper according to the first embodiment of the present invention, illustrating the actuating mechanisms thereof.

In FIG. 4, a longitudinal cross sectional view illustrates the actuating mechanism within the housing 12. The actuating lever 13 of the leaf spring type toe nail clipper has a semi-spherical recess 11 which receives the radiused end 30 of an axially reciprocating plunger rod 28. The upper end of the plunger rod 28 is connected by a pivot pin 26 to the end portion of the movable scissor lever 20. The other scissor pivot lever 18 is fixed to the housing 12. The leaf spring cutting elements 16 and 17 of the nail clippers are secured together and to the bottom portion of the housing 12 by a rivet 21. As may now be readily understood, by squeezing the scissor actuating mechanism handles 22 and 24 together, the axial plunger rod 28 will be forced downwardly, depressing nail clippers actuation lever 13, which causes the cutting elements 16 and 17 to move together in a toe nail shearing action. The various elements of the invention may be formed from metal or plastic and the stationary scissor lever 18 may be secured to the housing 12 by glue, welding or by other conventional fastening methods.

Figure 5:
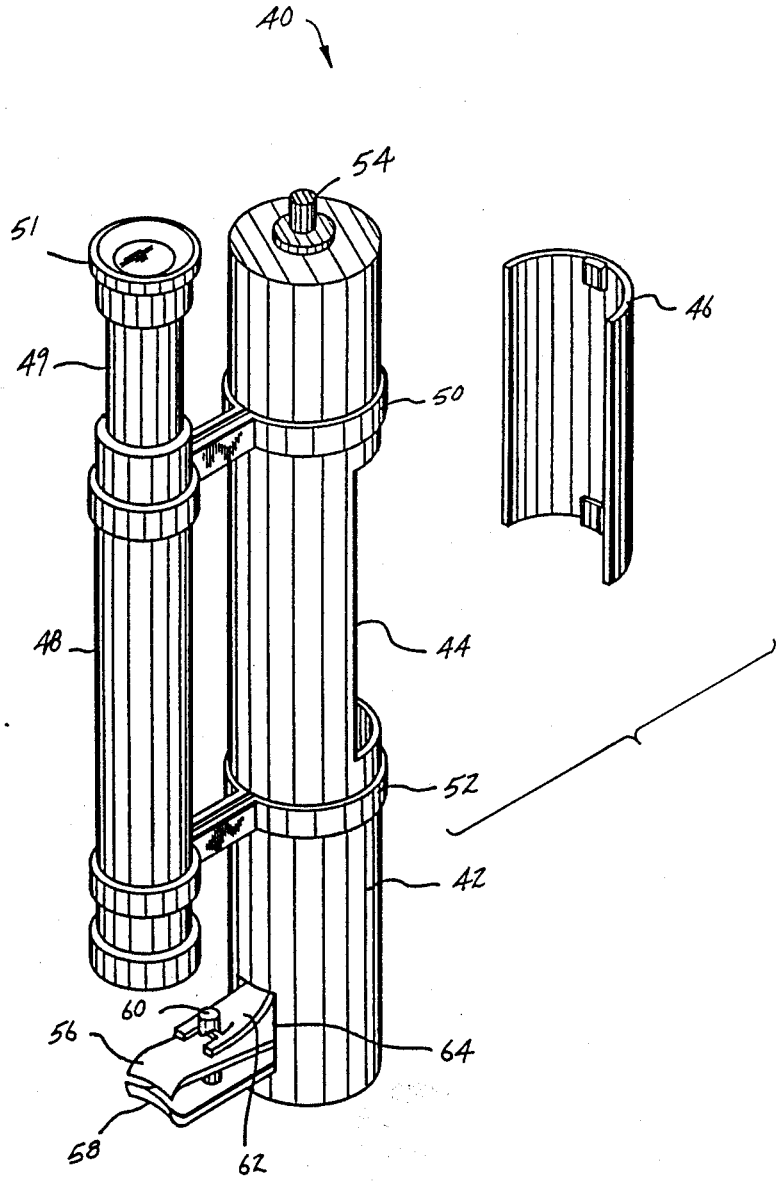
FIG. 5 is a perspective view of the remotely actuated toe nail clipper according to the second embodiment of the present invention.

With reference now to FIG. 5, a second embodiment 40 of the present invention will now be described. More specifically, the second embodiment 40 of the present invention includes an elongated hollow cylindrical tubular housing 42 which has an elongated notch 44 formed by the removal of a cylindrical side wall portion 46. The cylindrical side wall portion 46 forms a cover for a battery compartment within the housing 42. A conventional type of telescope 48 is secured by spaced mounting rings 50 and 52 to the cylindrical housing 42. The elongated telescope body 48 extends in generally parallel relation with the housing 42. An eye piece 51 of the telescope is mounted for adjustable axial sliding movement on a barrel 49 of the telescope 48. This allows the focus of the telescope to be adjusted. A conventional type of leaf spring nail clipper mechanism extends transversely from a slot 64 formed adjacent the bottom portion of the housing 42. The leaf spring type nail clipper mechanism includes first 56 and second 58 leaf spring cutting elements which are connected in generally parallel relation by a pin 60 which extends transversely through aperatures in each of the cutting elements 56 and 58. An actuating lever 62 engages a recess in the pin 60 in conventional fashion for forcing the cutting elements 56 and 58 together in a toe nail shearing cutting action. An electrical push button switch 54 is disposed on a top end of the housing 42 for a purpose to be described subsequently.

Figure 6:
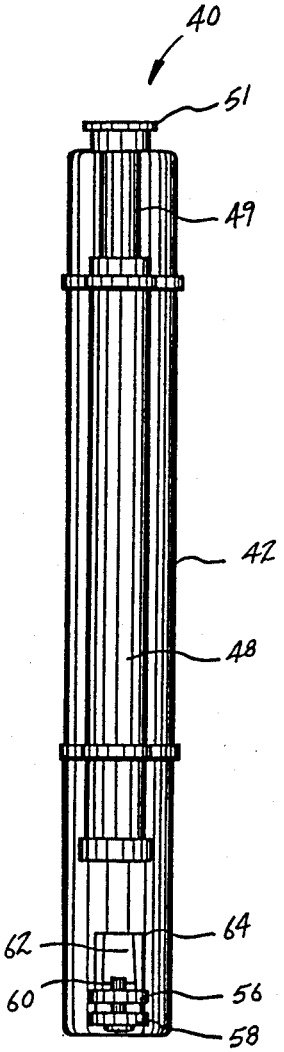
FIG. 6 is a front view of the remotely actuated toe nail clipper according to the second embodiment of the present invention.

FIG. 6 provides a front view of the remotely actuated toe nail clipper 40 of the present invention.

Figure 7:
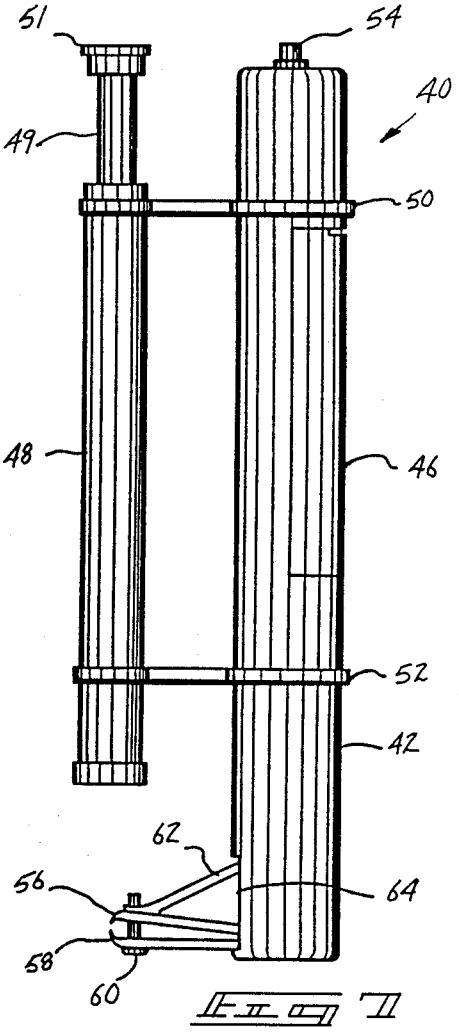
FIG. 7 side view of the remotely actuated toe nail clipper according to the second embodiment of the present invention.

As shown in the side view of FIG. 7, the telescope 48 is aligned with the operative portion of the leaf spring type toe nail clipper mechanism. In particular, an individual with a toe nail situated between the cutting elements 56 and 58 may obtain a clear view of the toe nail trimming operation by looking through the eye piece 51 of the telescope 48. As previously mentioned, by axially sliding the adjustment barrel 49, the focus of the telescope may be adjusted to suit each individual user.

Figure 8:
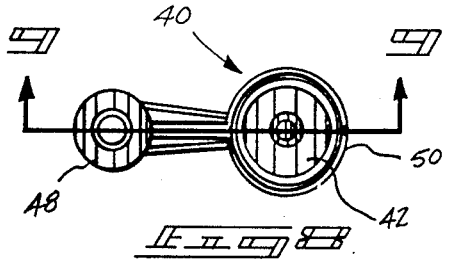
FIG. 8 is a top view of the remotely actuated toe nail clipper according to the second embodiment of the present invention.

In FIG. 8, a top view of the remotely actuated toe nail clipper 40 of the present invention is provided.

Figure 9:
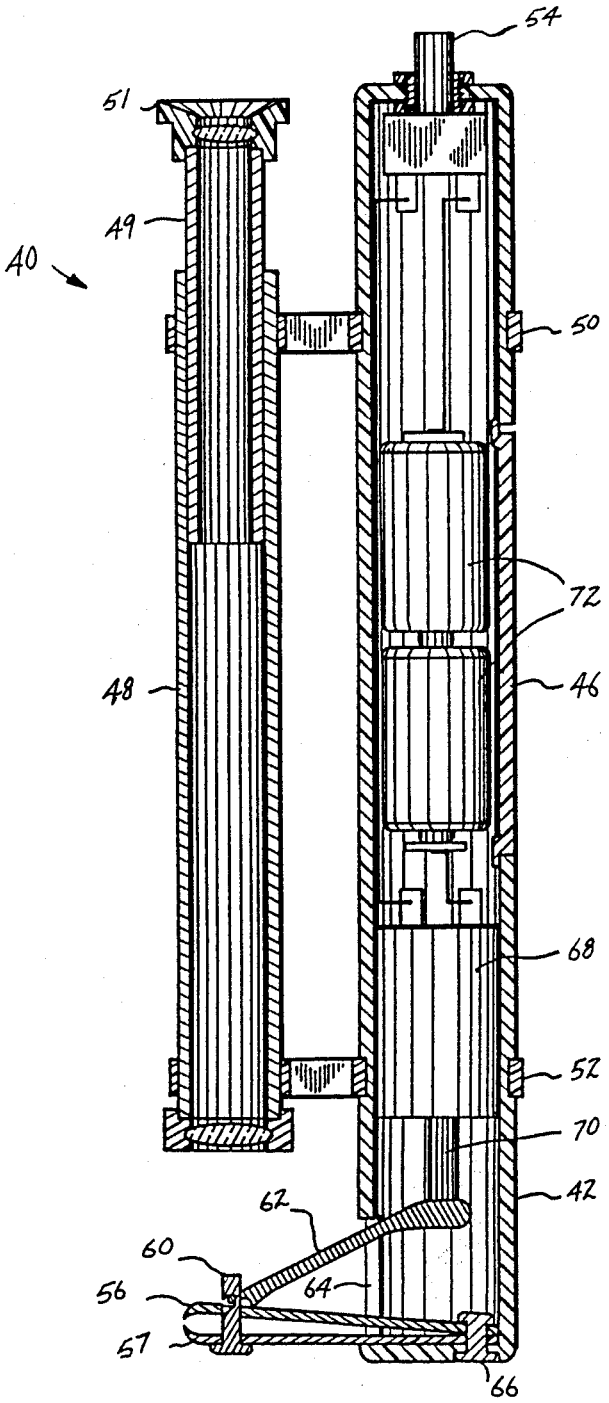
FIG. 9 is a longitudinal cross sectional view, taken along line 9—9 of FIG. 8, illustrating the operating mechanism of the remotely actuated toe nail clipper according to the second embodiment of the present invention.

In FIG. 9, longitudinal cross sectional view taken along line 9—9 of FIG. 8 illustrates the internal working mechanisms of the toe nail clipper 40. The actuating lever 62 of the leaf spring type toe nail trimmer is secured to an axially movable plunger 70 of an electric solenoid 68. The solenoid 68 is powered by a pair of conventional batteries 72. Actuation of the solenoid 68 is achieved by a push button type switch 54. The leaf spring cutting elements 56 and 57 of the toe nail trimmer are secured together and to the bottom portion of the housing 42 by a rivet 66. These leaf spring elements 56, 57 provide a spring force which biases the actuating lever 62 upwardly to the illustrated position. In addition to the restorative axial spring force of the leaf spring elements 56 and 57, the solenoid 68 may be of a type containing an internal coil spring which biases the plunger 70 to an axially upward retracted position when the solenoid 68 is not energized. The manner of use of the toe nail clipper 40 according to the second embodiment is quite simple. An individual places their toe nail to be trimmed between the cutting elements 56 and 57. The proper toe nail alignment may be achieved by individuals of even very poor eye sight through the use of the telescope 48. When the toe nail is situated in the correctly aligned position, the individual depresses the push button switch 54 actuating the solenoid 68 which axially downwardly extends the plunger 70, depressing the attached toe nail actuation lever 62. This forces the cutting elements 56 and 57 together, thus shearing the toe nail.

While the telescope 48 has been described with reference to the second embodiment 40 of the present invention, it is readily apparent that this telescope may be attached by similar mounting rings 50 and 52 to the toe nail clipper 10 of the first embodiment of the present invention. In this construction, the scissor actuating mechanism would merely extend transversely from a side portion of the housing 12, to allow the telescope to be positioned in alignment with the cutting elements 16 and 17.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A remotely actuated toe nail clipper, comprising:
an elongated hollow cylindrical housing;
a leaf spring type nail clipper adjacent a bottom portion of said housing, said nail clipper having first and second leaf spring cutting elements extending in parallel relation;
rivet means securing a first end of said leaf spring cutting elements together and to said bottom housing portion;
a pin extending transversely through aligned apertures in said first and second cutting elements;
an actuating lever engaging an end portion of said pin; and
an axially movable plunger in said housing with a bottom end portion of said plunger in engagement with said actuating lever.

2. The remotely actuated toe nail clipper of claim 1, further comprising means extending from a top portion of said housing for axially downwardly extending said plunger.

3. The remotely actuated toe nail clipper of claim 2, wherein said plunger actuating means comprises a pivotal scissor mechanism.

4. The remotely actuated toe nail clipper of claim 2, wherein said plunger actuating means comprises switch means operatively connected for actuating electric solenoid means for extending said plunger.

5. The remotely actuated toe nail clipper of claim 1, further comprising optical magnification means on said housing for providing a user with a view of said nail clipper.

6. The remotely actuated toe nail clipper of claim 5, wherein said optical magnification means comprises an elongated telescope secured in spaced parallel relation to said elongated housing.

* * * * *